US010473435B2

(12) United States Patent
Park et al.

(10) Patent No.: US 10,473,435 B2
(45) Date of Patent: Nov. 12, 2019

(54) ARMOUR

(71) Applicant: BAE SYSTEMS plc, London (GB)

(72) Inventors: Nicholas Park, Bristol (GB); Simon Anthony Jenkins, Bristol (GB); David Townsend, Bristol (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 15/739,302

(22) PCT Filed: Jun. 24, 2015

(86) PCT No.: PCT/GB2015/000197

§ 371 (c)(1),
(2) Date: Dec. 22, 2017

(87) PCT Pub. No.: WO2016/207580

PCT Pub. Date: Dec. 29, 2016

(65) Prior Publication Data

US 2018/0172406 A1 Jun. 21, 2018

(51) Int. Cl.

| | |
|---|---|
| ***F41H 5/04*** | (2006.01) |
| ***F41H 5/02*** | (2006.01) |
| *F41H 7/04* | (2006.01) |

(52) U.S. Cl.
CPC ..... *F41H 5/04* (2013.01); *F41H 5/02* (2013.01); *F41H 7/04* (2013.01)

(58) Field of Classification Search
CPC ..... F41H 5/04; F41H 5/02; F41H 7/04
USPC ..... 89/36.02
See application file for complete search history.

(56) References Cited

U.S. PATENT DOCUMENTS

| | | | | |
|---|---|---|---|---|
| 2,318,301 A * | 5/1943 | Eger | F41H 5/0457 | 109/81 |
| 3,230,414 A * | 1/1966 | Karger | H04N 3/223 | 315/406 |
| 5,217,185 A * | 6/1993 | Rucker | B64G 1/58 | 244/121 |
| 5,738,925 A * | 4/1998 | Chaput | B32B 3/10 | 428/101 |

(Continued)

FOREIGN PATENT DOCUMENTS

| | | |
|---|---|---|
| DE | 3122367 C1 | 12/1994 |
| EP | 2781876 A2 | 9/2014 |
| WO | 2016207580 A1 | 12/2016 |

OTHER PUBLICATIONS

International Preliminary Report on Patentability received for Patent Application No. PCT/GB2015/000197, dated Jan. 4, 2018. 7 pages.

(Continued)

*Primary Examiner* — Joshua E Freeman
(74) *Attorney, Agent, or Firm* — Finch & Maloney PLLC

(57) ABSTRACT

Armor comprising a container (2) containing a liquid (6), said container having a threat-facing wall (11) and at least one shock-reflecting layer (5) of material contained within the container (2), the shock-reflecting layer (5) having a shock impedance differing from the liquid (6) and being positioned at an angle to the threat-facing wall (11) whereby to reflect shock waves (8) created in the liquid by passage of a projectile (1) through the liquid back towards the projectile (1) and across the trajectory of the projectile whereby to induce tumbling of the projectile within the liquid.

20 Claims, 3 Drawing Sheets

(56) References Cited

U.S. PATENT DOCUMENTS 5,767,435 A * 6/1998 Reymann ..... F41H 5/0457 109/80
6,899,009 B2 * 5/2005 Christiansen ..... E06B 9/00 89/36.02
7,080,587 B2 * 7/2006 Benyami ..... F41H 5/007 89/36.02
7,866,106 B2 * 1/2011 Bowlware ..... E01F 13/12 404/6
8,074,552 B1 * 12/2011 Imholt ..... F41H 5/045 89/36.01
8,746,122 B1 * 6/2014 Roland ..... F41H 5/04 89/36.02
2006/0027088 A1 * 2/2006 Wulvik ..... F41H 1/00 89/36.02
2011/0072959 A1 * 3/2011 Petrovich ..... F41H 5/007 89/36.02
2011/0198788 A1 * 8/2011 Hines ..... F41H 1/02 267/136
2011/0277621 A1 * 11/2011 Joynt ..... F41H 7/042 89/36.02
2011/0308379 A1 * 12/2011 Imholt ..... F41H 5/045 89/36.02
2011/0308380 A1 * 12/2011 Imholt ..... F41H 5/023 89/36.02
2012/0174756 A1 * 7/2012 Wilson ..... F41H 5/04 89/36.02
2012/0312607 A1 * 12/2012 Joynt ..... F41H 5/023 180/54.1
2014/0130657 A1 * 5/2014 Pilpel ..... F41H 5/0485 89/36.02
2014/0260935 A1 * 9/2014 Kocher, Jr. ..... F41H 7/042 89/36.02
2015/0168106 A1 * 6/2015 Pyles ..... F41H 5/0457 89/36.02
2015/0268005 A1 * 9/2015 Keren ..... F41H 5/013 89/36.02
2016/0178326 A1 * 6/2016 Strauss ..... F41H 5/04 89/36.02
2016/0195367 A1 * 7/2016 Dry ..... F41H 5/007 89/36.02
2017/0226891 A1 * 8/2017 Twelves, Jr. ..... F01D 25/005
2017/0231371 A1 * 8/2017 Li ..... A45F 3/06 62/259.3

OTHER PUBLICATIONS

International Search Report and Written Opinion received for Patent Application No. PCT/GB2015/000197, dated Nov. 11, 2015. 8 pages.

* cited by examiner

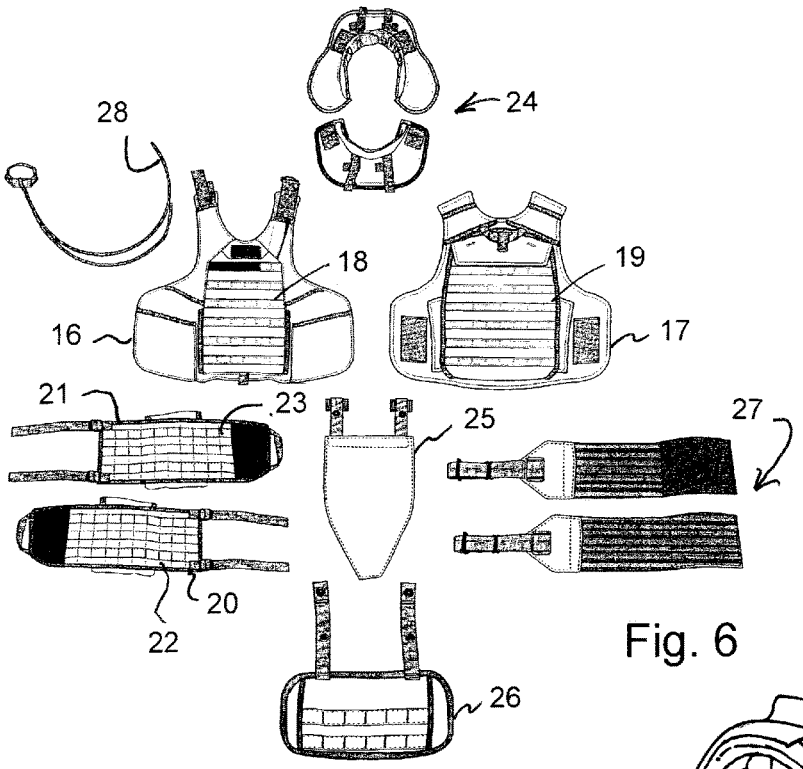
Fig. 6
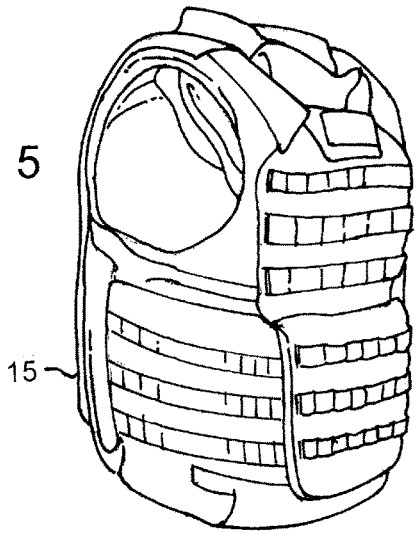
Fig. 5
Fig. 7
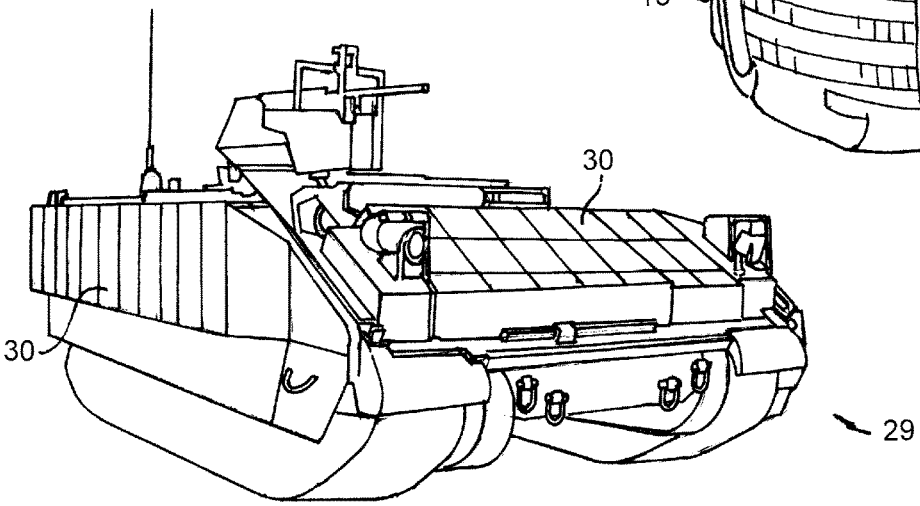

ARMOUR

The present invention relates to armour and in particular to armour for attachment to a platform or a person as body-worn armour to protect the platform or person from projectile threats.

In present-day warfare, the threats are many and varied. In addition, platforms, which may be fixed or movable such as land, water-borne or air-borne vehicles, are used in many theatres and scenarios.

For vehicles in particular, lightweight armour can be of considerable benefit as the performance of the vehicle itself may be more effectively maintained. Often, with heavier armour, the range of the vehicle or its capability or both may be compromised by the need to carry armour.

For body-worn armour, the weight of the armour can make the difference between the armour being light enough to wear and not.

Thus, a relatively lightweight armour which is effective at defeating projectiles such as bullets would be of benefit.

According to a first aspect of the invention there is provided armour comprising a container containing a liquid, said container having a threat-facing wall and at least one shock-reflecting layer of material contained within the container, the shock-reflecting layer having a shock impedance differing from the liquid and being positioned at an angle to the threat-facing wall whereby to reflect shock waves created in the liquid by passage of a projectile through the liquid back towards the projectile and across the trajectory of the projectile whereby to induce tumbling of the projectile within the liquid.

The invention therefore provides an armour system which uses the shock pressure generated in a liquid by a projectile such as a bullet impacting the armour to allow and, in fact enhance, the natural tendency of the projectile to tumble and thus provide the retardation forces necessary to slow or stop the projectile.

The penetration performance of a bullet or rod type projectile is dramatically reduced by inducing yaw in the projectile. When penetrating a liquid, a projectile with a slight angle of yaw will experience a turning moment due to high drag forces acting through the centre of pressure. The centre of pressure, being ahead of the centre of gravity, will destabilise the projectile further. A restoring couple due to any spin of the projectile may not be sufficient to stabilise the projectile which may only be designed to produce stable flight in atmosphere. Drag forces in the liquid will be approximately three orders of magnitude higher than in atmosphere, due to the differences in density of air to and a typical liquid.

This phenomenon is illustrated in FIG. 1. A 7.62 mm AP bullet 1, seen as a dark shadow 13, enters a water filled container 2 at a velocity of 1112 m/s on the left of each image. This results in the formation of a cavity 12, with the bullet 1 at the head, which cavity 12 extends as the bullet travels through the water 6. In FIG. 1*c*, a distinct asymmetry is observed in the shape of the cavity 12, caused by the tumbling of the bullet 1. The asymmetry becomes more pronounced in the later figures as the rate of tumbling of the bullet 1 increases and the velocity of the bullet decreases. The high drag forces on the bullet 1 also cause shearing of a copper jacket 3 of the bullet 1 which is ripped from a core (not separately shown) and is evident in a ragged front 14 of the dark shadow 13, in FIGS. 1*g* and 1*h*.

It is known that a high speed projectile entering a liquid generates an intense shock pulse within the liquid; this is known as the hydrodynamic ram (HRam) effect. From investigations previously undertaken by the inventors, the impact of a 7.62 mm bullet travelling at 1112 m/s into a water filled container (see FIG. 1) produced a shock pulse of approximately 380 bars with a duration of 120 μs.

The invention is shown here to use shockwave interaction with lightweight inserts or layers in the container to defeat small arms bullets. The projectile on entering the liquid produces a shockwave which travels ahead of, and out to the sides of, the projectile. The shock wave, on reaching a lightweight layer within the liquid, due to a difference in shock impedance of the layer compared to the liquid, generates a reflected pressure wave across the bullet's path. The magnitude of the reflected pressure wave is determined by the mismatch in shock impedance of the lightweight material of the layer compared to the liquid, and the direction of the wave is determined by the shape and orientation of the layer.

As the reflected pressure wave passes across the bullet's path, the bullet will experience high, short duration asymmetric forces which will induce rapid tumbling of the bullet. The tumbling bullet rapidly decelerates in the liquid and then continues to decelerate in the lightweight material of the layer or layers due to the increase in presented area of the bullet caused by the tumbling. Thus, the yaw angle of the projectile combined with the obliquity of the shock-reflecting layer dramatically improves the ballistic protection offered by the invention.

The shock-reflecting layer may comprise material having a lower shock impedance than the liquid and may have a generally planar face.

The shock-reflecting layer or layers may be positioned at an orientation of between 0 deg and 45 deg to an expected direction of projectile travel, more preferably between 0 deg and 30 deg, more preferably still between 0 deg and 15 deg and most preferably between 0 deg and 10 deg. Thus, these orientations may correspond to the layer or layers being positioned at between 45 deg and 90 deg to the threat-facing wall. Lastly, the shock-reflecting layer may be positioned at an angle of substantially 90° to the threat-facing wall The lower the number of shock-reflecting layers there are in the container, the greater the container depth (in the direction of projectile travel) which is likely to be required in order to ensure that the shock wave emanating from the projectile has time to be reflected back to the projectile to induce tumble before the projectile strikes a rear wall of the container.

A rear face of the container may also be angled to an expected direction of projectile travel; this will additionally introduce obliquity to the impact geometry and may additionally reflect a shock wave across the path of the projectile. Thus, for example, if the direction of expected projectile travel is normal to the threat-facing wall of the container, a rear wall of the container may be angled with respect to the threat-facing wall.

The liquid may be in the form of a gel and the term "liquid" is to be taken to mean both a liquid and a gel, herein.

Materials suitable for the shock-reflecting layers include foams such as engineering foams. The foams may be plastic (or polymer) based to keep weight down. The cell structure should preferably be closed to prevent liquid ingress. Whether or not an open cell foam structure is to be used, each layer may be encased in a liquid-proof membrane to prevent liquid ingress into the cell structure.

Metallic foams may not be preferred, owing to their greater weight. Some examples of suitable foams are:

STYROFOAM SP-X—an extruded polystyrene board traditionally used in industrial cold store floors owing to its combination of high strength and resistance to deformation. Density (aim): 38 kg/m3.

LAST-A-FOAM FR-3700—a closed-cell rigid polyurethane foam. Density: 48 kg/m3. LAST-A-FOAM provides a high strength-to-weight ratio with grades specifically designed for applications immersed in a liquid.

IMPAXX 500 Energy Absorbing Foams (DOW Automotive)—a highly engineered polystyrene-based thermoplastic foam. Density: 43 kg/m3. IMPAXX foams are mainly used for automotive applications to absorb the impact energy in the event of a crash.

In addition to protection against projectiles, the invention may provide at least a degree of blast protection.

The container may be designed to be filled and emptied, as desired, with a liquid inlet/outlet, and so may be arranged to be empty for transportation, for example. In this way, the weight of a platform, armoured according to the invention, may be reduced considerably, when required. Such an arrangement may allow for cheaper transportation of an armoured platform or may even enable transport by air instead of by land or by water. Thus, for military operations, vital time may be saved when armour according to the invention is employed.

The armour may be compartmentalised into separate containers. Such an arrangement may allow transfer of liquids from one place to another around the armour and hence around the platform on which the armour is mounted.

Such an arrangement may be useful when it is known from which direction threats are coming, at any given time. In such circumstances, either a selected set of containers may be filled with liquid or liquid may be moved from one set of containers to another. Movement of the liquid may be achieved manually, by gravity feed or by pumping the liquid between containers.

For circumstances when rapid dumping of liquid from one or more containers is required, outlets from the containers may be provided of a size to allow this rapid dumping of liquid.

One or more containers may be adapted to receive drinking water and or fuel for a vehicle. A vehicle or other platform may therefore be adapted accordingly.

Alternatively or in addition, one or more containers may be adapted to be used as part of a vehicle cooling system.

It is envisaged that the armour of the invention, while being particularly suitable for use on vehicles, owing to its relatively light weight, may also find use as body-worn armour.

The invention will now be described, by way of example only, with reference to the accompanying drawings of which:—

FIGS. 1*a* to 1*h* are a series of successive photographic images of a bullet travelling through water (prior art);

FIG. 5 is a perspective view of a military protective vest according to the invention;

FIG. 6 shows the separate components making up the vest of FIG. 5, and

FIG. 7 is a perspective view of an armoured vehicle utilising armour according to the invention.

Figure 2:
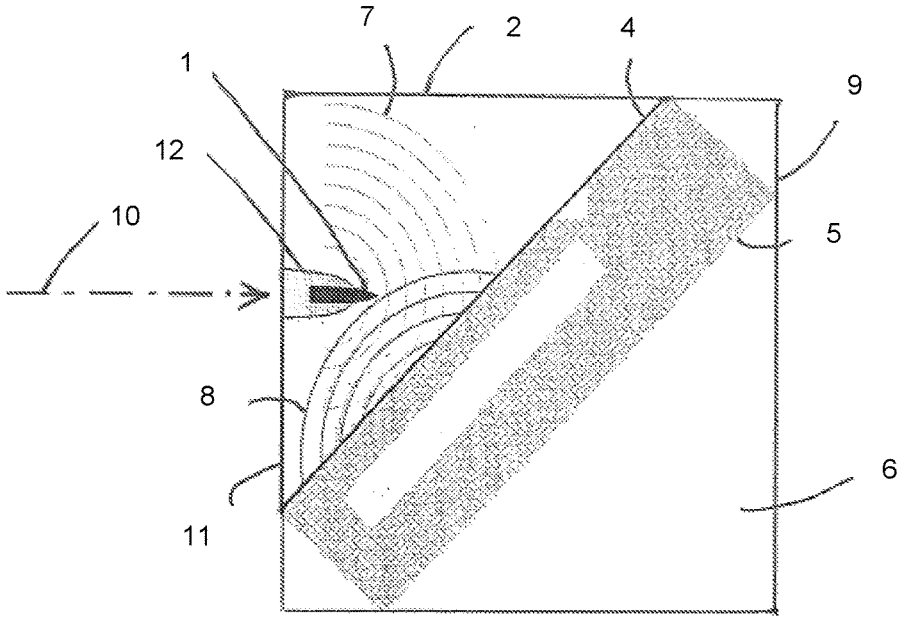
FIG. 2 is a schematic view of reflection of a shock wave from a low shock impedance layer, the shock wave being generated in a liquid by passage of a high speed projectile through the liquid, according to the invention.

Referring to FIG. 2, a shock reflecting surface 4 is defined on a layer 5 of Styrofoam™ within a container 2. The layer 5 is shown at an exaggerated angle to the projectile path 10, for clarity in illustrating generated shock waves. The layer 5 of Styrofoam has a low shock impedance compared to a liquid 6 filling the container 2. Upon passage of a projectile 1 through the liquid 6, a series of incident shock waves 7 in the liquid are reflected as reflected release waves 8, formed at the shock reflecting surface 4. The series of reflected waves 8 propagates back through the liquid 6 from the reflecting surface 4 towards the projectile. There is little evidence of shock transmission through the Styrofoam layer 5.

The first part of a mechanism to defeat the projectile relies on using the energy in each reflected shock wave 8 to produce a transverse flow or pressure in the liquid adjacent to the projectile 1. By employing reflective layers 5 of specific orientation, within the container, and constructed of a material with different shock impedance to the liquid 6, the shock wave produced by the projectile 1 will be reflected back across the path of the projectile to cause it to tumble.

Figure 1:
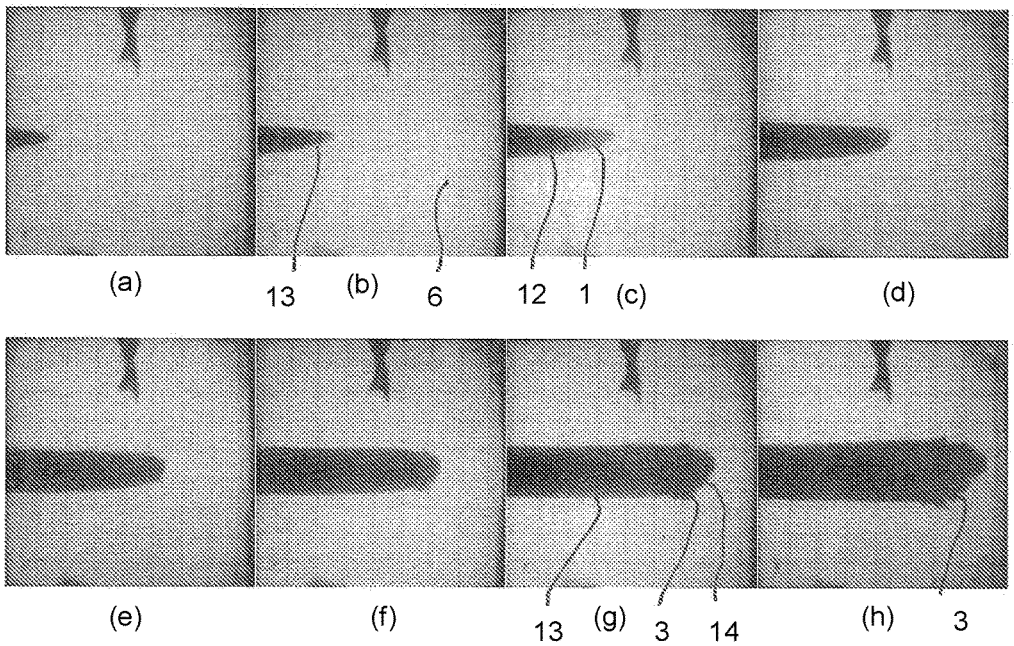

The stress magnitude of the reflected release wave 8 and of the shock wave 7 transmitted into the foam material 5 can be calculated from the shock Hugoniots for the materials. Using the example described in FIG. 1, a 7.62 mm bullet 1 travelling at 1112 m/s, with a polyurethane foam reflector 5, the incident shock wave 7 of 380 bar produced by the bullet 1 produces a reflected release wave 8 from the foam 5 estimated to be minus 230 bars. The release wave front 8 will propagate through the incident wave 7, effectively reducing the pressure by 230 bars, to approximately 150 bars. The unloading of the incident shock 7 by the release wave 8 will result in a pressure differential and flow of water across the bullet trajectory. It is this pressure differential that drives projectile instability.

The increase in yaw angle of a tumbling projectile 1 will increase the drag forces on the projectile in the liquid 6 and thereby increase the retardation of the projectile in the liquid. Furthermore, the ability of the projectile 1 to penetrate a rear component or wall 9 in the armour system will be greatly reduced by increasing yaw angle of the projectile. If a face of the rear component 9 is also angled (not shown) to an expected direction of projectile travel, this will additionally introduce obliquity to the impact geometry. This combination of yaw of the projectile and obliquity will greatly reduce the penetrating capability of the projectile.

Figure 3:
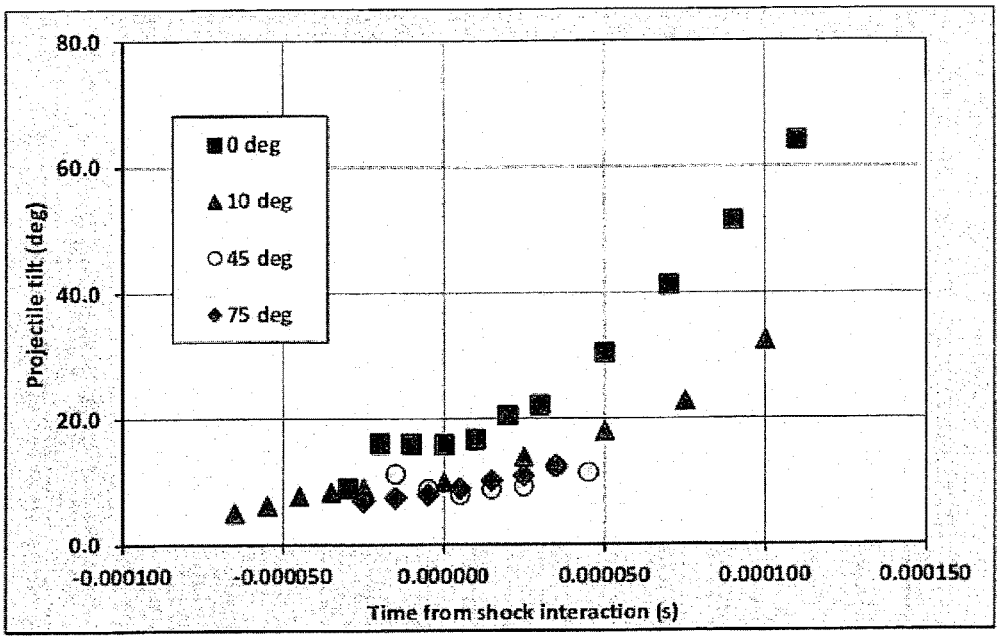
FIG. 3 is a comparative graph of projectile tilt plotted against elapsed time from reflection of a shock wave caused by the projectile passing through a liquid.

A number of designs have been proved by experiment. To tumble a high speed bullet in water, it was found that the best performance was achieved when the reflected shockwave was directly across the path of the bullet (see FIG. 3). The greatest degree of tumble was achieved with the shock reflecting surface at an orientation of between 0 deg and 10 deg to the projectile path 10 (see FIG. 4), with best results obtained at the lower end of this range.

Figure 4:
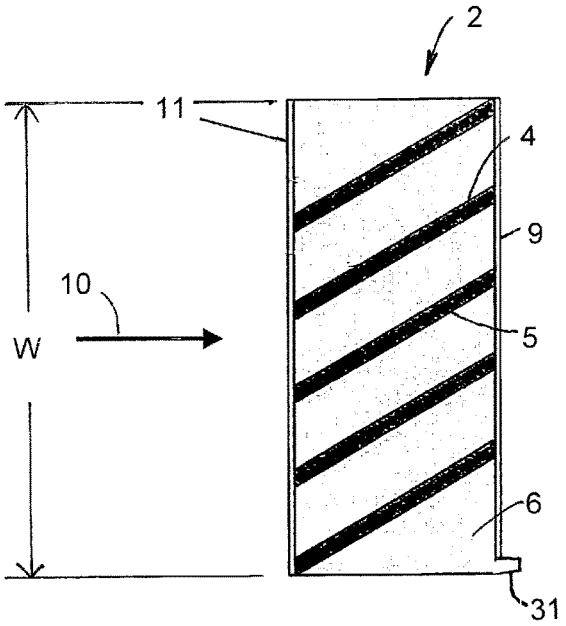
FIG. 4 shows, schematically, shock reflecting armour according to the invention.

The design shown in FIG. 4 generally corresponds to this data, with the layers 5 shown at an exaggerated angle to the projectile path 10. Here, a water filled tank 2 of depth 100 mm, as measured along the projectile path 10, is shown. The tank 2 is shown skinned with glass reinforced plastics material 11, 2 mm thick, although aluminium sheet material may suitably be used instead. A series of inclined foam layers 5, here made of Styrofoam, is distributed throughout the tank 2. These foam layers 5 are 10 mm to 20 mm thick and span the width W of the tank 2. According to the results shown in FIG. 3, the inclination of the layers 5 to the projectile path 10 is more likely to be nearer 0 deg than the approximately 45 deg, shown here.

Referring to FIG. 5, a military vest 15 is shown, assembled on a mannequin.

FIG. 6 shows component parts of the vest 15 of FIG. 5, disassembled. Referring to FIG. 6, a front carrier 16 and rear carrier 17 for armour inserts 18, 19 according to the invention are shown. Right- and left-hand carriers 20, 21 of armour 22, 23 according to the invention are also shown. The assembly also includes a ballistic collar 24, a groin protector 25 and a lower back protector 26, all of which may be adapted to receive armour according to the invention. Finally, the assembly includes an elastic internal band assembly 27 and a quick release assembly 28.

FIG. 7 shows a tracked armoured vehicle 29, fitted with armour containers 30 according to the invention. The containers or panels 30 may be in liquid connection with each other and possibly a liquid filling/drainage system (not shown) for the vehicle and have inlets/outlets 31 for the liquid.

Liquid-filled armour is itself not heavy, compared to rolled homogenised steel, for example, and the armour of the invention, with lightweight inserts within the liquid will be lighter still. With the additional benefit of the lightweight shock-reflecting layers of the invention producing the enhanced tumbling effect on the projectile, and hence enhanced retardation, the armour of the invention becomes particularly beneficial.

The invention claimed is:

1. Armour for protecting a platform, the armour comprising a container for containing a liquid, said container having a forward threat-facing wall, a rear platform-facing wall and at least one shock-reflecting layer of material contained within the container, the shock-reflecting layer having a shock impedance differing from that of a liquid or a gel with which the container is to be filled and being positioned at an angle to the threat-facing wall whereby to reflect shock waves created in the liquid by passage of a projectile through the liquid back towards the projectile and across the trajectory of the projectile to induce tumbling of the projectile within the container, wherein the shock-reflecting layer is positioned at an oblique angle between 80° and 90° with respect to the threat-facing wall.

2. The armour according to claim 1, in which the shock-reflecting layer comprises material having a lower shock impedance than the liquid.

3. The armour according to claim 1, in which the shock-reflecting layer has a generally planar face.

4. The armour according to claim 1, in which the shock-reflecting layer comprises foam material.

5. The armour according to claim 4, in which the foam material is closed cell material.

6. The armour according to claim 4, in which the foam material is enclosed in a liquid-proof membrane.

7. The armour according to claim 1, in which the shock-reflecting layer is attached to both the forward and rear walls.

8. The armour according to claim 1, including:

a series of shock-reflecting layers evenly distributed across the armour, in a direction across the threat-facing wall.

9. The armour according to claim 1, in which the armour is compartmentalised into separate containers, such that liquid from a first container cannot enter a second container, wherein the shock-reflecting layer is a first shock-reflecting layer that is within the first container, and wherein the armour comprises a second shock-reflecting layer that is within the second container.

10. The armour according to claim 1, comprising a liquid storage tank for a platform on which the armour is mounted, and an inlet/outlet for the liquid.

11. A vehicle including the armour according to claim 1.

12. The armour according to claim 1, wherein the platform is a human and the armour is adapted and shaped to fit at least a portion of a human body and be worn as body armour.

13. The armour according to claim 1, wherein the shock-reflecting layer is impervious to the liquid or the gel.

14. The armour according to claim 1, wherein the shock-reflecting layer comprises non-metallic foam material.

15. The armour according to claim 1, wherein the shock-reflecting layer comprises at least one of polyurethane foam, polystyrene board, or polystyrene-based thermoplastic foam.

16. The armour according to claim 1, wherein the rear platform-facing wall is angled with respect to the forward threat-facing wall.

17. The armour according to claim 1, wherein the armour comprises a plurality of shock-reflecting layers, wherein each shock-reflecting layer of the plurality of shock-reflecting layers is enclosed in a corresponding liquid-proof membrane.

18. The armour according to claim 1, in which the armour is compartmentalised into separate containers, such that liquid from a first container cannot enter a second container.

19. Armour comprising a container for containing a liquid, said container having a first wall, a second wall, and at least one shock-reflecting layer of foam material contained within the container between the first and second walls, the shock-reflecting layer having a shock impedance differing from that of a liquid with which the container is to be filled and being positioned at an oblique angle between 80° and 90° with respect to at least one of the first wall and the second wall.

20. The armour according to claim 19, wherein the shock-reflecting layer has a generally planar face, and the shock-reflecting layer is attached to both the first and second walls, wherein the foam material is at least one of a closed cell material or enclosed in a liquid-proof membrane, wherein the armour is adapted to fit at least a portion of a human body and be worn as body armour, and wherein the shock-reflecting layer is impervious to the liquid or the gel.

* * * * *